US011511399B2

(12) United States Patent
Batt

(10) Patent No.: US 11,511,399 B2
(45) Date of Patent: Nov. 29, 2022

(54) METHODS AND APPARATUS TO REMOVE FRANGIBLE FASTENER REMNANTS

(71) Applicant: The Boeing Company, Chicago, IL (US)

(72) Inventor: Edward John Batt, Mount Pleasant, SC (US)

(73) Assignee: The Boeing Company, Chicago, IL (US)

( * ) Notice: Subject to any disclaimer, the term of this patent is extended or adjusted under 35 U.S.C. 154(b) by 545 days.

(21) Appl. No.: 16/658,811

(22) Filed: Oct. 21, 2019

(65) Prior Publication Data

US 2021/0114186 A1 Apr. 22, 2021

(51) Int. Cl.
*B25B 21/00* (2006.01)
*B25B 23/145* (2006.01)

(52) U.S. Cl.
CPC ..... *B25B 21/002* (2013.01); *B25B 23/145* (2013.01)

(58) Field of Classification Search
CPC ..... B25B 23/145; B25B 21/002; B25B 23/02; B25B 23/1415
See application file for complete search history.

(56) References Cited

U.S. PATENT DOCUMENTS 4,000,668 A * 1/1977 Keasler ..... B25B 27/0014 81/55
4,593,583 A * 6/1986 Singleton ..... B25B 23/1415 81/55
8,430,001 B2 * 4/2013 Ortiz ..... B25B 13/06 81/125
9,120,209 B1 * 9/2015 Schevers ..... B25B 21/002
10,974,310 B2 * 4/2021 Cobzaru ..... B21J 15/18
2012/0186405 A1 * 7/2012 Ortiz ..... B25B 23/00 81/180.1
2014/0276500 A1 * 9/2014 Scott ..... A61F 5/4404 604/338
2019/0120274 A1 * 4/2019 Johnson ..... F16B 31/021

OTHER PUBLICATIONS

"USATCO C-24 Hi-Shear Installation and Removal," USATCO U.S. Air Tool Co., Accessed Oct. 8, 2019, 11 pages.

* cited by examiner

*Primary Examiner* — Andrew M Tecco
*Assistant Examiner* — Nicholas E Igbokwe
(74) *Attorney, Agent, or Firm* — Hanley, Flight & Zimmerman, LLC

(57) ABSTRACT

Methods and apparatus to remove frangible fastener remnants are disclosed. A disclosed example apparatus to install a frangible fastener includes a drive tool having a drive socket operable to rotate a separable nut portion of the frangible fastener, and a fastener interface defining an interior for receiving at least the nut portion, the fastener interface being disposed on a drive end of the drive tool, where the drive socket is movable within the fastener interface and operable to rotate the frangible fastener, and where the separable nut portion of the frangible fastener is removed when the frangible fastener is installed. The apparatus also includes a nut-portion removal tube depending from the interior of the fastener interface, and a vacuum generator in fluid communication with the removal tube and configured to cause the separable nut portion to be removed from the interior and through the removal tube.

20 Claims, 8 Drawing Sheets

METHODS AND APPARATUS TO REMOVE FRANGIBLE FASTENER REMNANTS

FIELD OF THE DISCLOSURE

This disclosure relates generally to installation of frangible components and, more particularly, to methods and apparatus to remove frangible fastener remnants.

BACKGROUND

During installation of a frangible fastener, a removable portion of the frangible fastener is separated therefrom. In particular, the frangible fastener typically includes a removable collar that is separable from a corresponding body. To couple the frangible fastener to another component, the frangible fastener is rotated by a tool, thereby causing the removable collar to separate from the body at a line of weakness. Often, the separated removable collar and/or associated remnants (i.e., debris) can fall onto a workplace floor, onto manufactured parts or into machinery.

SUMMARY

An example apparatus to install a frangible fastener includes a drive tool having a drive socket operable to rotate a separable nut portion of the frangible fastener, a fastener interface defining an interior for receiving at least the nut portion, the fastener interface being disposed on a drive end of the drive tool, where the drive socket is movable within fastener interface and operable to rotate the frangible fastener, and where the separable nut portion of the frangible fastener is removed when the frangible fastener is installed, a nut-portion removal tube depending from the interior of the fastener interface, and a vacuum generator in fluid communication with the removal tube and configured to cause the separable nut portion to be removed from the interior and through the removal tool.

An example method of assembling a frangible fastener includes providing an induced vacuum in a removal tube depending from an interior of a fastener interface positioned on or proximate an installation surface, wherein the frangible fastener is disposed within the interior, moving the frangible fastener, via a drive socket at last partially disposed in the interior, to install the frangible fastener and separate a removable nut portion from the frangible fastener; and removing, via the induced vacuum, the removable nut portion of the frangible fastener from the interior and through the removal tube.

Figure 1A:
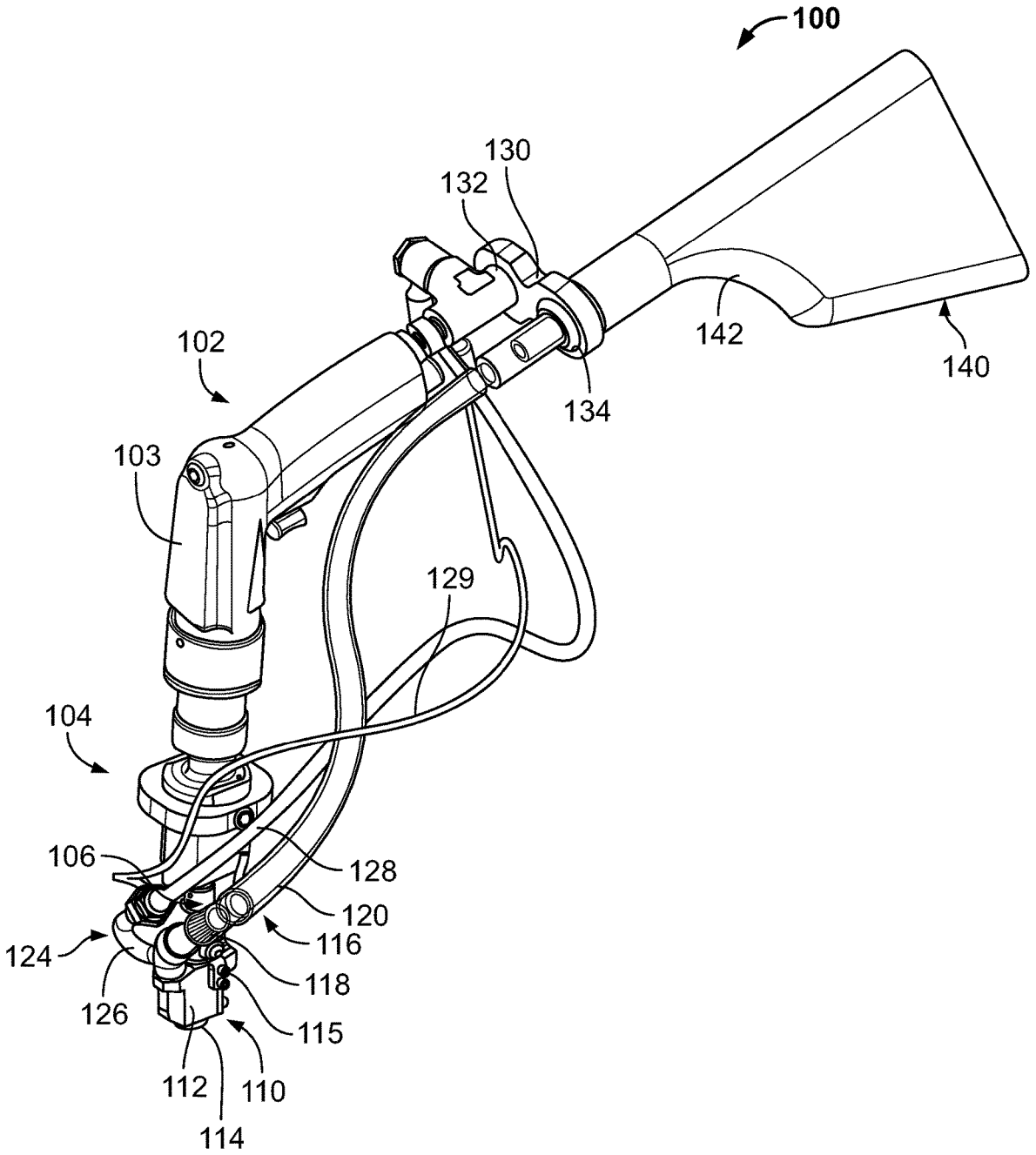
FIGS. 1A and 1B are perspective views of an example frangible fastener installation system in accordance with teachings of this disclosure.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part is in any way on (e.g., positioned on, located on, disposed on, or formed on, etc.) another part, indicates that the referenced part is either in contact with the other part, or that the referenced part is above the other part with one or more intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in contact with another part means that there is no intermediate part between the two parts.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

Methods and apparatus to remove frangible fastener remnants are disclosed. Installation of a frangible fastener onto another component typically involves separation of a removable portion (e.g., a removable collar) from a body. In particular, a tool interfaces with and rotates the frangible fastener, thereby causing the removable portion to separate from the body of the fastener at a line of weakness. As a result of this separation, the removable portion and associated remnants or debris can contaminate parts, get into machinery and/or cover a work area, thereby necessitating clean-up efforts, which can be time-consuming and involve labor.

Examples disclosed herein enable effective removal (e.g., elimination) of separated frangible fastener portions and associated debris or remnants. Examples disclosed herein implement a fastener interface (e.g., an installation block) that includes and/or defines an interior, internal chamber or cavity. The fastener interface is to be placed into contact with or proximate an installation surface such that the cavity at least partially surrounds a frangible fastener. In turn, a tool at least partially disposed within the cavity is operated to move the frangible fastener (e.g., rotate the frangible fastener via a socket of the tool), thereby separating a removable nut portion of the frangible fastener from a corresponding body. Examples disclosed herein implement a vacuum generator and, optionally, a pressurized fluid line (e.g., a blower line) fluidly coupled to the cavity to facilitate removal of the removable nut portion, thereby preventing the removable portion and associated debris or remnants from entering a work area, a tool and/or production components.

In some examples, pressurized air from the pressurized fluid line moves within the cavity and transversely past the frangible fastener to facilitate transport of the removable portion into a removal tube and debris collection line. In some such examples, the pressurized air flows generally perpendicular to a longitudinal axis of the frangible fastener. In some examples, a spring is implemented between the block and a support mount supporting the fastener interface to enable a movement of the fastener interface relative to the support mount while sufficiently restraining the fastener interface. In some examples, a semi-permeable collection bag, which may be at least partially composed of Delrin® (or any other non-marring material), is fluidly coupled to the removal tube to receive and capture the removable nut portion(s) and associated remnants. In some examples, the vacuum generator comprises a venturi vacuum generator defined by pressurized fluid line that is angled relative to the removal tube by approximately 35 to 55 degrees.

As used herein, the term "frangible" refers to a component and/or device that is designed to have a permanently separable portion and/or section, which can be discarded. As used herein, the terms "removable portion," "removable nut portion" and "removable collar" refer to a portion of a frangible fastener that is separated from the frangible fastener when the frangible fastener is installed onto another component. As used herein, the term "fluid coupling" refers to a component, device and/or assembly that is structured to direct, facilitate movement of and/or transport a fluid, such as air, for example.

FIG. 1A is a perspective view of an example frangible fastener installation system (e.g., a frangible fastener installation tool, a hand-held frangible fastener installation system, etc.) 100 in accordance with teachings of this disclosure.

The frangible fastener installation system 100 of the illustrated example includes a drive tool 102 having a support handle 103 and a drive end 104, which includes a tool stem 106, and a fastener interface 110 generally in the shape of a block. The fastener interface 110 includes a housing body 112, and a surface contact portion 114. The housing body 112 may optionally include a blower cap 115 in communication with a pressurized fluid line 129 (e.g. a blower line).

To facilitate capture of debris and/or removable nut portions, the example frangible fastener installation system 100 also includes a debris collection line 116 with a collection hose 120 and a nut removal tube 118. The frangible fastener installation system 100 also includes a supply hose 128 associated with a vacuum generator 124 that is configured to establish a vacuum in removal tube 118 and/or the debris collection line 116. The frangible fastener installation system 100 may also include a support collar 130 with a tool mount opening 132 and a collection line opening 134.

To capture the debris and/or the removable portions, the frangible fastener installation system 100 of the illustrated example includes a collection bag 140, which is at least partially composed of Delrin (e.g., a nose tip portion of the collection bag 140 is at least partially composed of Delrin®, for example, or any other appropriate non-marring material. The example collection bag 140 is semi-permeable and/or permeable to air (e.g., compressed air) and includes an angled contour or surface 142 to facilitate movement of the debris and/or the removable portions. However, any appropriate storage mechanism can be implemented instead (e.g., a storage compartment, a storage box, a disposal area, a containment unit, etc.).

Figure 1B:
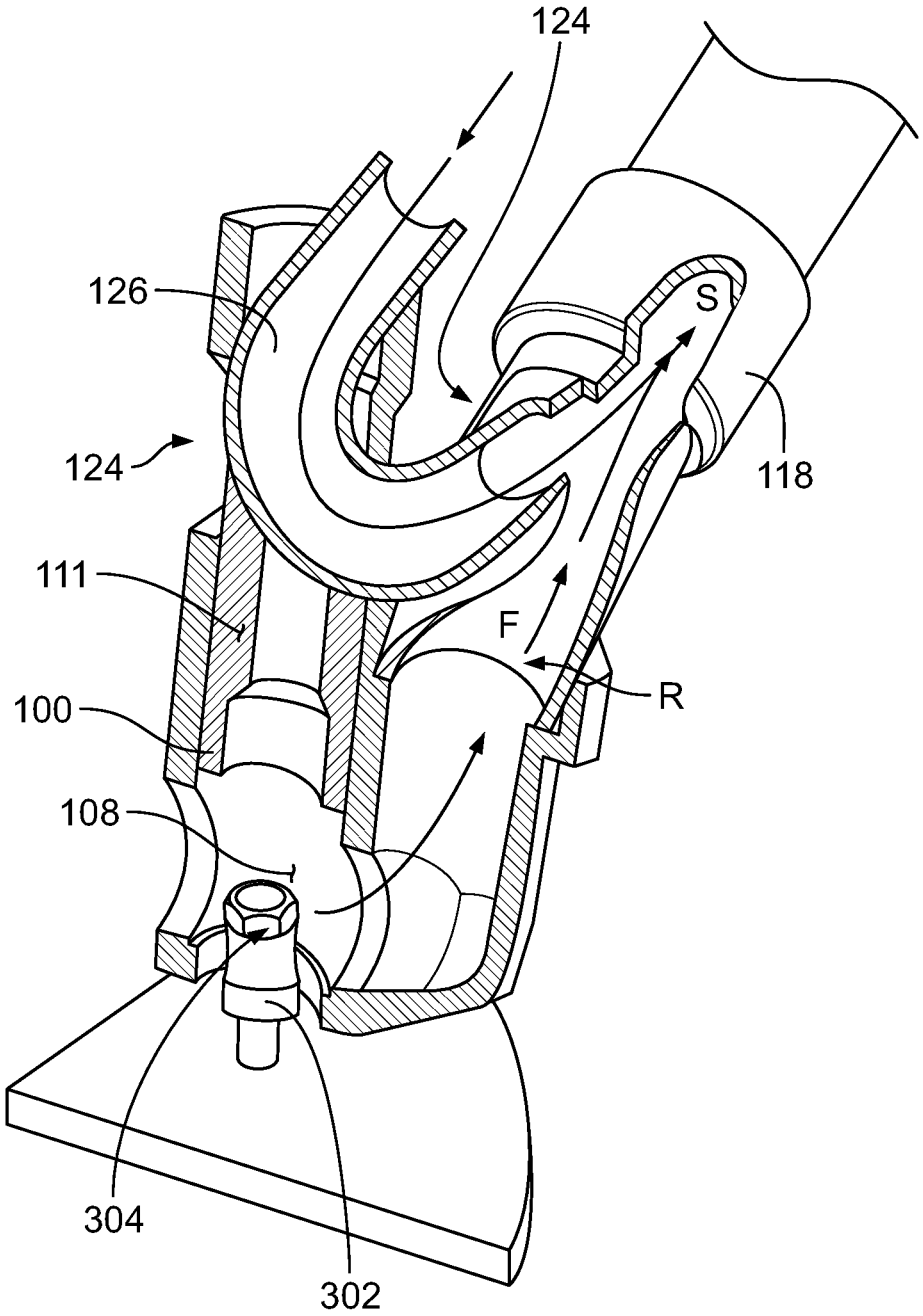
Figure 3:
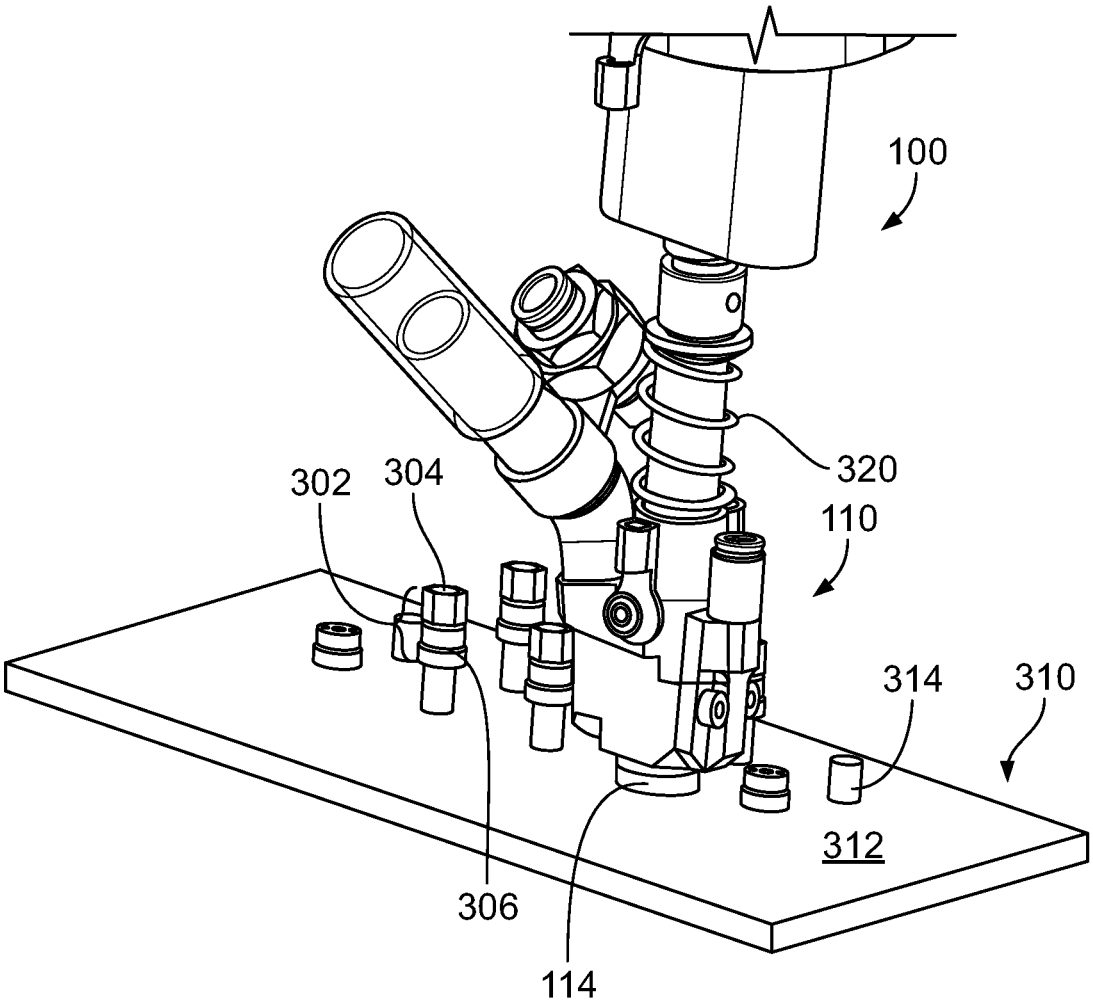
FIG. 3 illustrates use of the example frangible fastener installation system of FIGS. 1A-2.

As shown in the partial cutaway in FIG. 1B, the drive tool 102 includes a movable socket driver 111 that is at least partially disposed in the fastener interface 110, and is operable to engage and rotate a nut portion (e.g., a separable nut portion, a separated nut portion, a removable nut portion, etc.) 304 of a frangible fastener 302 to be secured onto a post 314, all of which are shown in FIG. 3. The nut portion 304 is configured to separate from the frangible fastener 302 by rotation of the nut portion 304 after the frangible fastener is secured to the post 314. The fastener interface 110 is disposed on a drive end 104 of drive tool 102. The fastener interface 110 has an interior 108 for receiving at least the nut portion 304 of the frangible fastener 302. A nut portion removal tube 118 depends from the interior 108 of the fastener interface 110. The vacuum generator 124 is in fluid communication with the removal tube 118, and is configured to cause a separated nut portion 304 to be removed from the interior 108 and moved through the removal tube 118. In some examples, the vacuum generator 124 comprises a venturi chamber at the coupling junction of the removal tube 118 and a conduit 126, through with pressurized fluid flow from supply hose 128 is directed towards an evacuation end of the removal tube 118, where the pressurized fluid flow stream S establishes a vacuum (or low pressure) in region R that induces a flow F for urging and/or causing a separated nut portion 304 to exit the interior 108 and move through the removal tube 118.

Alternatively, the vacuum generator 124 may comprise an external vacuum generator source that is in fluid communication with the debris collection line 116 and/or the collection bag 140 (by coupling of an alternately positioned conduit 126'), where the external vacuum generator source establishes a vacuum (or a relatively low pressure) in the debris collection line's collection hose 120 and the nut removal tube 118, to cause or induce a vacuum effect for urging and/or causing a separated nut portion 304 to exit the interior 108 and travel through the removal tube 118 and collection hose 120 to the collection bag 140.

Figure 2:
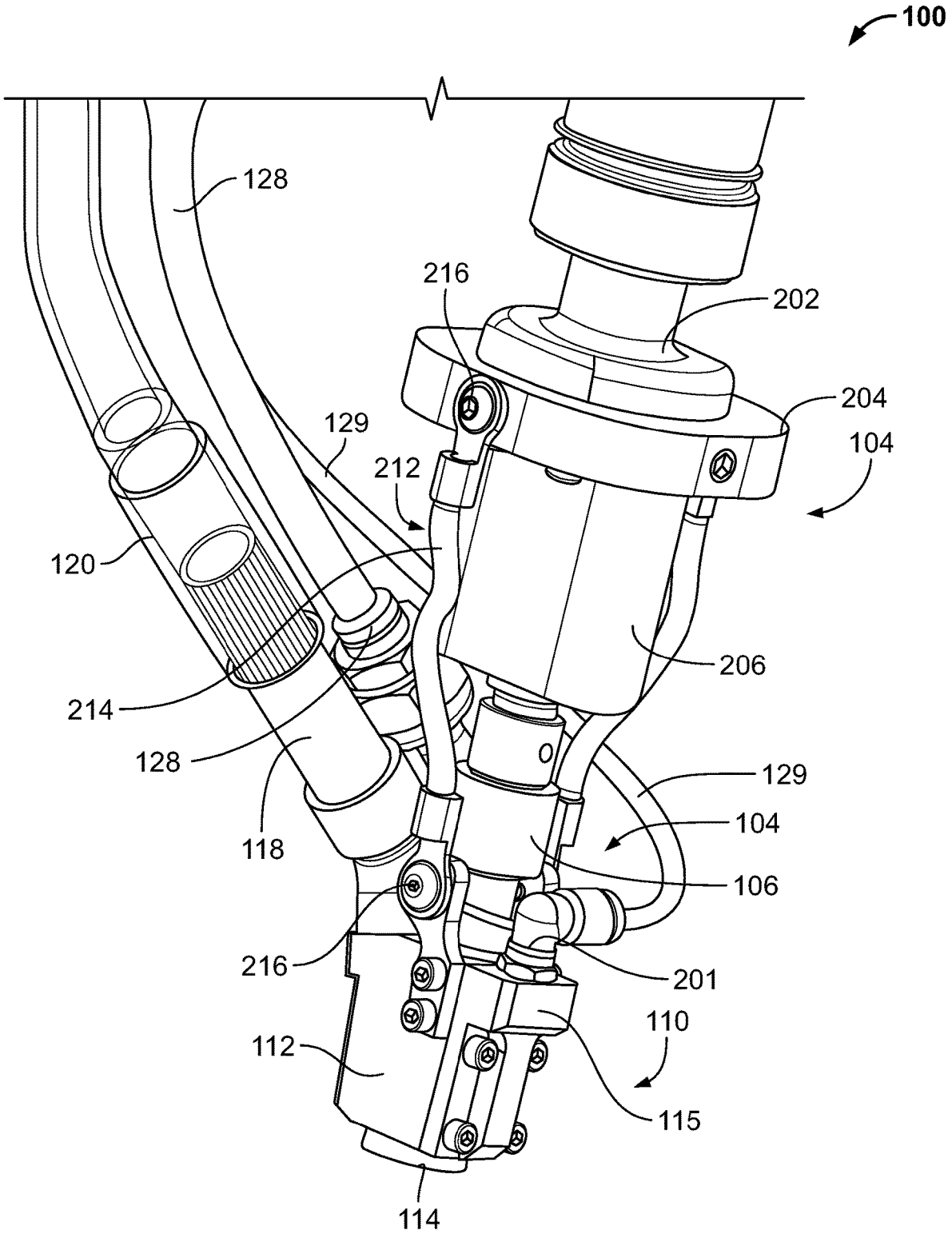
FIG. 2 is a detailed view of a portion of the example frangible fastener installation system of FIGS. 1A and 1B.

FIG. 2 is a detailed view of a portion of the example frangible fastener installation system 100 of FIGS. 1A and 1B. In the illustrated example of FIG. 2, the housing body 112 of the fastener interface 110 supports the nut portion removal tube 118 and the collection hose 120. Similarly, the example fastener interface 110 also supports the conduit 126 and, thus, the supply hose 128. Further, the optional blower cap 115, a fitting 201 (e.g., an elbow fitting) and the pressurized fluid line 129 are also supported by the fastener interface 110.

In the illustrated example, the drive end 104 and the contact portion 114 can move relative to a support 202 that supports a mount 204. In turn, a housing body 206 extends from the mount 204, thereby aligning and positioning the aforementioned tool stem 106, which extends into the fastener interface 110. In some examples, a spring member 212, which includes an elastic member 214 extending between support mounts (e.g., fastener mounts) 216, enables the fastener interface 110 to move relative to the drive end 104 and, thus, enables a certain degree of relative movement therebetween while appropriately restraining movement of the fastener interface 110. As will be discussed in greater detail below in connection with FIGS. 3-8, the fastener interface 110 is generally aligned with a frangible fastener and used to couple the frangible fastener to another component while reducing (e.g., eliminating) any resultant remains, debris and/or remnants that can cause undesirable operation or require secondary cleaning operations, which can incur cost and production downtime.

FIG. 3 illustrates use of the example frangible fastener installation system 100 of FIGS. 1A-2. In the illustrated example, the fastener interface 110 is implemented to assemble the frangible fasteners 302, which include respective removable portions (e.g., frangible collars, removable collars, separated/separable portions, disposable portions, etc.) 304 and bodies (e.g., body portions, base portions, bases, etc.) 306. In this example, a workpiece (e.g., a plate, a contoured wall, a curved wall, etc.) 310 includes a surface (e.g., a manufacturing surface, a work surface, etc.) 312 with posts 314 extending therefrom.

In operation, the frangible fastener installation system 100 is implemented to install the frangible fasteners 302 onto the posts 314 extending from the surface 312 of the workpiece 310. Particularly, the support mount 102 (shown in FIG. 1A) is moved by an actuator or other movement device (e.g., a solenoid, etc.) along with the drive end 104 (also shown in FIG. 1A), to bring the contact portion 114 on or proximate the surface 312. Accordingly, the frangible fastener 302 is rotated to drive the frangible fastener 302 along a longitudinal length of the respective post 314 and, thus, closer to the surface 312. As will be discussed in greater detail below in connection with FIGS. 4-8, examples disclosed herein remove objects, debris and/or remnants that are separated from the frangible fasteners 302 as the frangible fasteners 302 are installed onto the posts 314. In some examples, a spring 320 is implemented to facilitate application of a compressive force (e.g., a pressure) between the contact portion 114 and the surface 312, thereby allowing more effective removal of the objects, debris and/or remnants.

Figure 4:
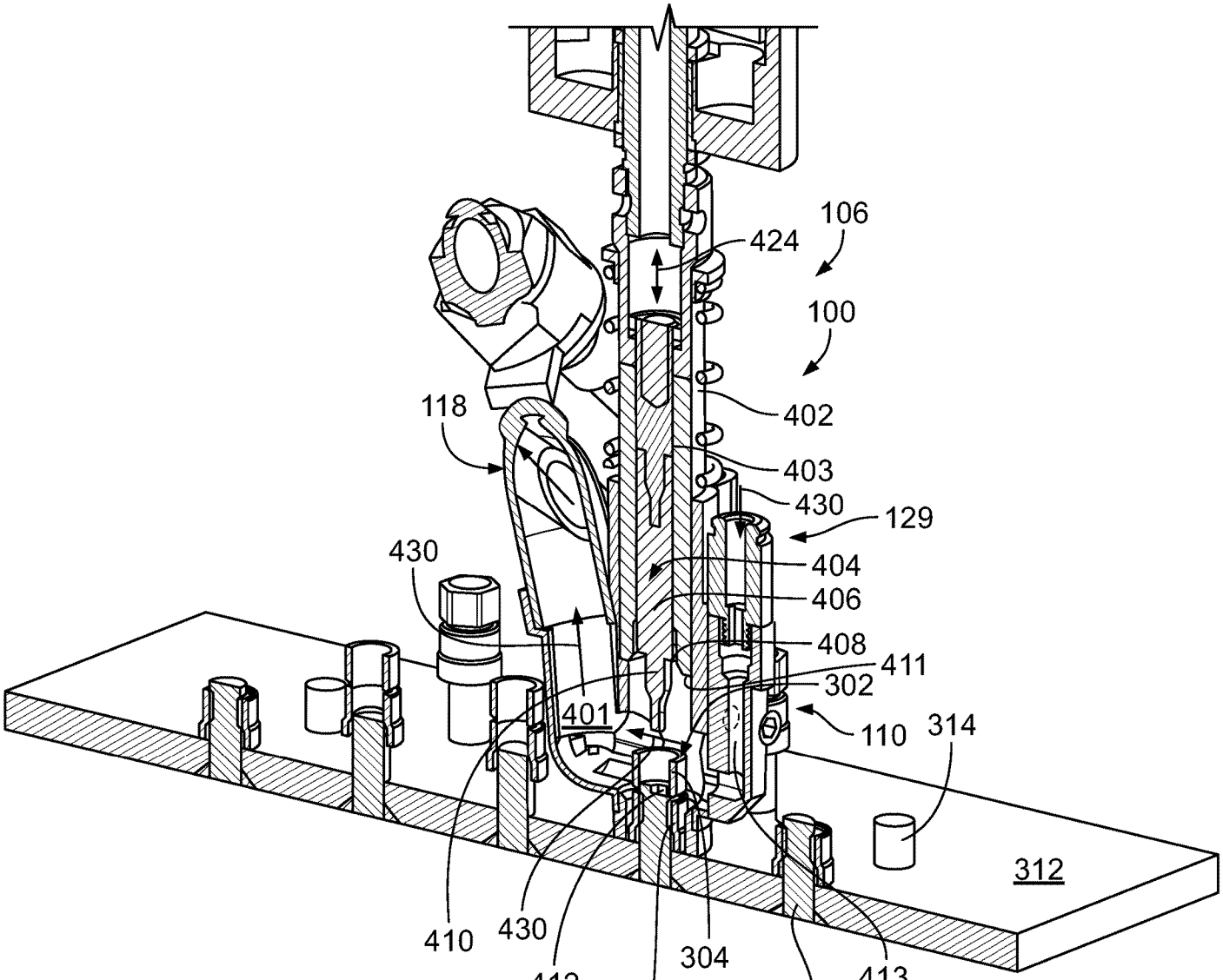
FIG. 4 is a partial cutaway view of the example frangible fastener installation system of FIGS. 1A-3.

FIG. 4 is a partial cutaway view of the example frangible fastener installation system 100 of FIGS. 1-3. In the illustrated example, the fastener interface 110 defines a cavity (e.g., an internal cavity, an internal recess, a chamber, an internal chamber, etc.) 401, which corresponds to the interior 108 in FIG. 1B. Further, the tool stem 106 includes a cylindrical body 402 having a central aperture 403 extending therethrough with a tool 404 disposed within. In turn, the example tool 404 includes a tool body 406, a shoulder (e.g., a shoulder ring) 408 and a shaft key 410 (e.g., a tool socket, a tool driver, a tool key, etc.). Further, a socket driver 411 (corresponding to socket driver 111 in FIG. 1B) is also disposed within the central aperture 403. The fastener interface 110 may optionally include an inlet manifold 413 (e.g., a blower manifold) coupled to the pressurized fluid line 129, which together are configured to supply pressurized fluid flow to blow a separated nut portion 304 in the cavity 401 towards the nut portion removal tube 118.

To fasten and tighten the frangible fastener 302 to the post 314, the tool 404 and the tip of shaft key 410 are movable in directions corresponding to a longitudinal length of the central aperture 403 to contact a tool interface 412 of the post 314 while the interface portion 114 contacts and/or is pressed against the surface 312. In particular, the tool 404 can displace in an upward and downward direction (in the view of FIG. 3), as generally indicated by a double arrow 424 to bring the tip of shaft key 410 into contact with the tool interface 412. In this example, the tool interface 412 is held stationary by the shaft key 410 while the driver 411 rotates the removable portion 304 and/or the frangible fastener 302 until the removable portion 304 is separated from the body 306 along a line of weakness located therebetween.

To remove the separated nut portion 304 from a vicinity of the frangible fastener 302, the vacuum generator 124 of the illustrated example is operated to draw the separated nut portion 304 and any associated debris away from the cavity 401 and urge the separated nut portion 304 to exit the cavity 401 and travel through the removal tube 118 (and the collection hose 120 to the collection bag 140, as shown in FIG. 1A). Further, the optional supply line 129 and inlet manifold 413 supplies pressurized fluid into the cavity 401. In this example, the pressurized fluid is compressed air and the vacuum generator 124 and the pressurized fluid line 129 are operated simultaneously during installation of the frangible fastener 302. As can be seen in the illustrated example of FIG. 4, a movement of the compressed air is generally indicated by arrows 430 and the compressed air flows into the pressurized fluid line 129 and across the cavity 401 in a direction generally perpendicular to a longitudinal axis of the shaft key 410. In other words, the compressed air flows transverse to the shaft key 410. Subsequent to passing through the cavity 401, the compressed air then flows through the vacuum line 116, thereby causing the removable nut portion 304 to be transported to the collection bag 140 shown in FIG. 1A. As a result, the removable nut portion 304 and/or any associated remnants (e.g., debris) are transported to the collection bag 140.

In some examples, the vacuum generator 124 is operated at different intervals (e.g., times) from the pressurized fluid line 129. In some such examples, the vacuum generator 124 can be operated (e.g., sequentially operated) after the pressurized fluid line 129 is operated and vice-versa. In some examples, the tip of the shaft key 410 is moved away from the tool interface 412 before the pressurized fluid line 129 and/or the vacuum generator 124 is operated. In some examples, the removable nut portion 304 is removed while the fastener interface 110 is in contact with the surface 312. In some examples, the interface portion 114 does not contact the surface 312 during removal of the removable nut portion 304.

Figure 5:
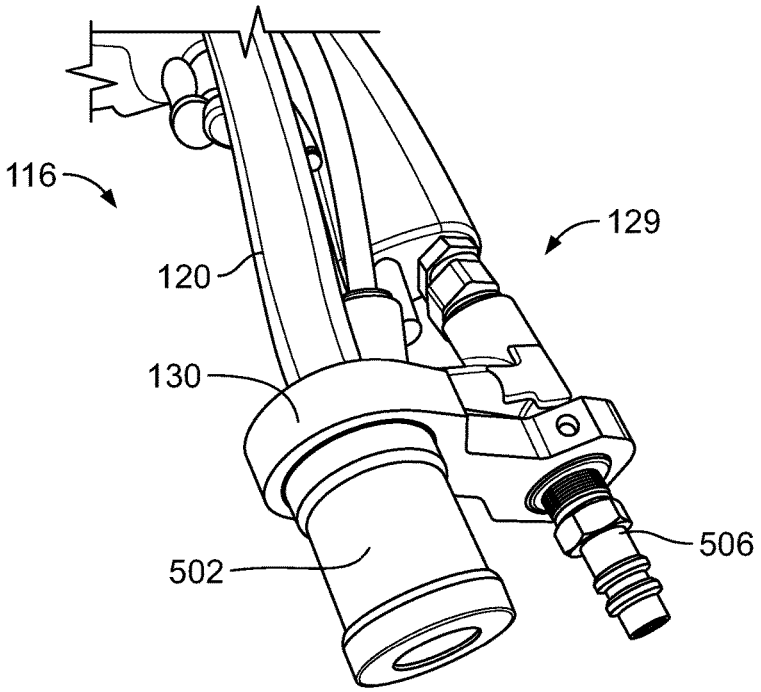
FIG. 5 illustrates an example hose attachment that can be implemented in examples disclosed herein.

FIG. 5 illustrates an example hose attachment 502 that can be implemented in examples disclosed herein. In the illustrated example, the hose attachment 502 is associated with the collection hose 120 of the debris collection line 116 and is supported and/or aligned by the aforementioned support collar 130. Further, a connection point (e.g., a connector) 506 associated with the pressurized fluid line 129 is shown aligned and positioned by the support collar 130. In this example, the support collar 130 enables reliable fluid coupling of the pressurized fluid line 129 and the debris collection line 116 during movement of the frangible fastener installation system 100.

Figure 6A:
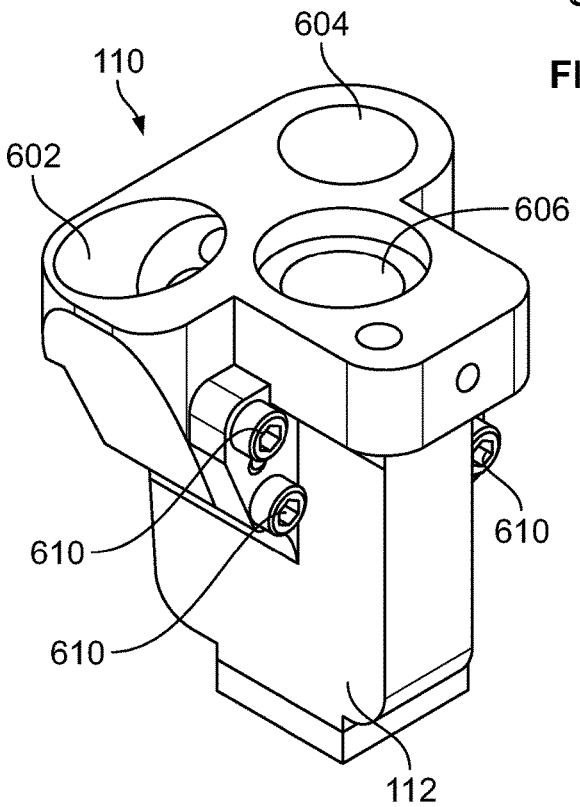
FIGS. 6A and 6B are top and bottom perspective views, respectively, of a fastener interface that can be implemented in examples disclosed herein.
Figure 6B:
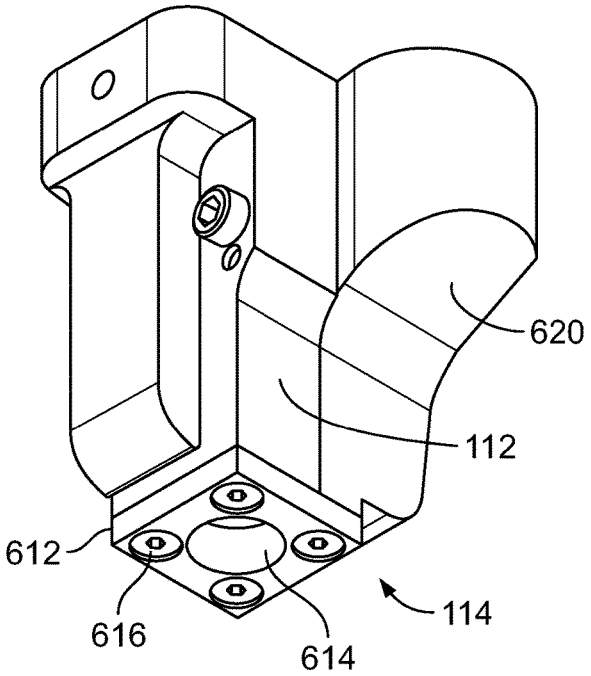

FIGS. 6A and 6B are top and bottom perspective views, respectively, of the block-shaped fastener interface 110 that can be implemented in examples disclosed herein. In this example, the fastener interface 110 includes the housing body 112 with a first fluid coupling (e.g., an angled opening) 602 corresponding to the nut removal tube 118. Likewise, a second fluid coupling (e.g., an opening 604) corresponds to the pressurized fluid line 129 and an opening 606 receives the tool 404 shown in FIG. 4. In this example, sub-components (e.g., sub-sections, etc.) of the housing body 112 are coupled together via fasteners 610.

Turning to FIG. 6B, a contact pad (e.g., a gasket, a sealing gasket, etc.) 612 of the contact portion 114 is shown coupled to the housing body 112 via fasteners 616. Further, the housing body 112 also exhibits an angled portion 620 corresponding to the first fluid coupling 602 shown in FIG. 6A to reduce a likelihood of the removable nut portion 304 being stuck in the vacuum line 116. In some examples, the contact pad 612 is implemented as an elastic material (e.g., an elastomer) to facilitate creation of a seal between the contact pad 612 and the surface 312. Further, the contact pad 612 and/or the contact portion 114 include an aperture 614 extending therethrough to receive at least the removable nut portion 304 of the frangible fastener 302. In this example, the contact pad 612 is coupled to the housing body 112 via fasteners (e.g., threaded fasteners) 616. In some examples, the aperture 614 is used to align the fastener interface 110 to the frangible fastener 302 (e.g., a keyed fit, a tolerance fit, etc.).

Figure 7:
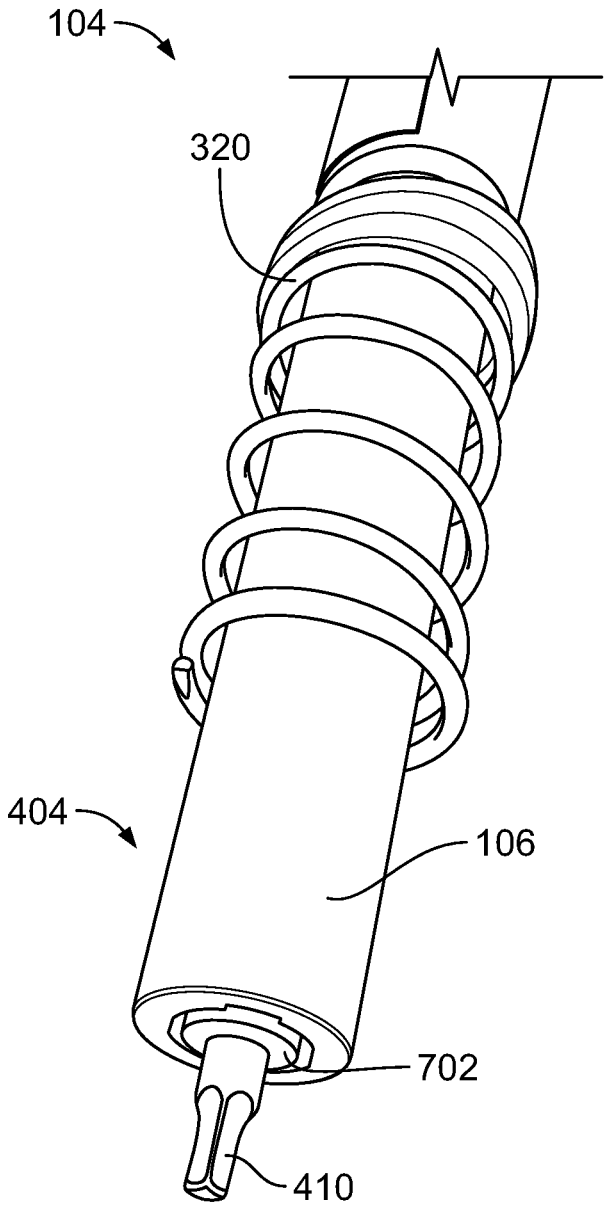
FIG. 7 is a detailed view of an example tool portion that can be implemented in examples disclosed herein.

FIG. 7 is a detailed view of the example drive end 104 of the drive tool 102 that can be implemented in examples disclosed herein. As can be seen in the illustrated example of FIG. 7, the tool 404 includes the tool stem 106, which is surrounded by the spring 320 and includes the tip of the shaft key 410 extending therefrom. In this example, a shoulder 702 extends from the tool stem 106 to enable an effective contact with the removable nut portion 304 of the frangible fastener 302.

Figure 8:
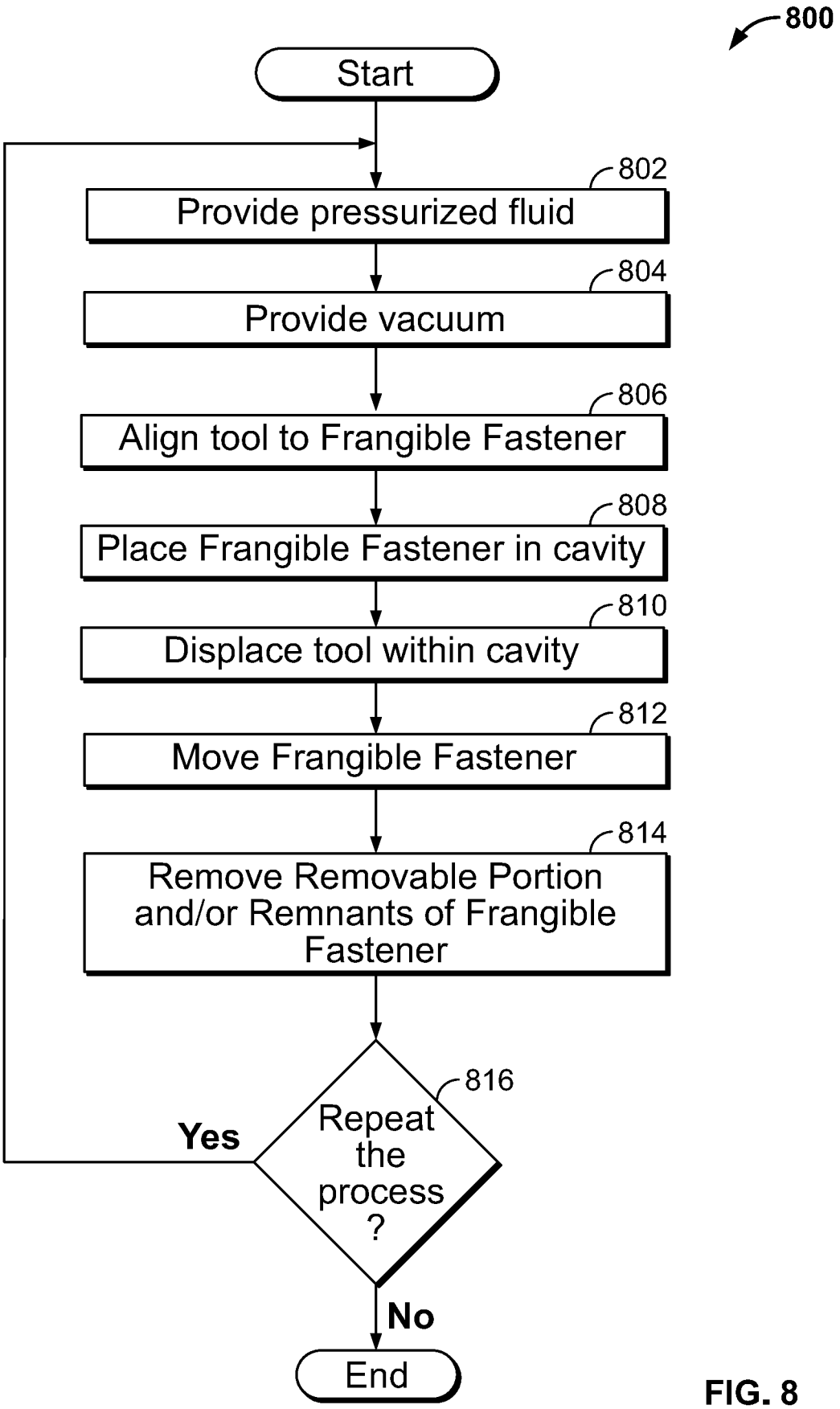
FIG. 8 is a flowchart representative of an example method to implement examples disclosed herein.

FIG. 8 is a flowchart representative of an example method 800 to implement examples disclosed herein. In this example, the frangible fastener 302 is being installed onto the post 314 by the frangible fastener installation system 100. Further, the post 314 is to be tightened to the workpiece 310 as the frangible fastener 302 is threaded onto the post 314.

At block 802, pressurized fluid may optionally be provided to the pressurized fluid line 129 and, in turn, the cavity 401, to blow and/or urge the separated nut portion towards the nut removal tube 118.

At block 804, a vacuum is provided by the vacuum generator 124 to urge the separated nut portion 304 to exit the cavity 401 and travel through the removal tube 118.

At block 806, the tool 404 and/or the tip of the shaft key 410 is aligned with the frangible fastener 302 and/or the removable nut portion 304 of the frangible fastener 302. For example, the shaft key 410 may be aligned with a collar and/or other external feature of the frangible fastener 302. Additionally or alternatively, the shaft key 410 and/or the tool 404 can be aligned to an outer surface of the frangible fastener 302.

At block 808, the frangible fastener 302 is placed within the cavity 401 based on movement of the frangible fastener installation system 100. In this example, the fastener interface 110 is moved to bring the interface portion 114 into compression against the surface 312 and to place the frangible fastener 302 within the cavity 401 (or interior of fastener interface).

At block 810, in some examples, the tool 404 and/or the shaft key 410 are displaced within or into the cavity 401. In this example, the shaft key 410 is displaced to contact the tool interface 412 of the post 314. Further, the socket driver 411 is placed onto the nut portion of the frangible fastener 302 (e.g., an outer hex-shaped exterior of the frangible fastener 302).

At block 812, the tool 404 and/or the socket driver 411 is rotated to move and/or rotate the frangible fastener 302, thereby causing the removable nut portion 304 to separate from the body 306 of frangible fastener 302. In this example, the socket driver 411 is implemented as a hex-shaped socket.

At block 814, the removable nut portion 304 and/or associated debris of the frangible fastener 302 are removed from the cavity 401. In particular, the removable nut portion 304 is separated from the corresponding body 306 and removed from the cavity 401 based on the operation of the vacuum generator 124 and debris collection line 116 and additionally the operation of the pressurized fluid line 129.

It is then determined whether to repeat the process (block 816). If the process is to be repeated (block 816), control of the process returns to block 802. Otherwise, the process ends. This determination may be based on whether further ones of the frangible fasteners 302 are to be installed.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

Example 1 includes an apparatus to install a frangible fastener. The apparatus includes a drive tool having a drive socket operable to rotate a separable nut portion of the frangible fastener, a fastener interface defining an interior for receiving at least the nut portion, where the fastener interface is disposed on a drive end of the drive tool, where the drive socket is movable within fastener interface and operable to rotate the frangible fastener, and where the separable nut portion of the frangible fastener is removed when the frangible fastener is installed, a nut-portion removal tube depending from the interior of the fastener interface, and a vacuum generator in fluid communication with the removal tube and configured to cause the separable nut portion to be removed from the interior and through the removal tool.

Example 2 includes the apparatus as defined in example 1, further including a spring operatively coupled between the fastener interface and the drive tool.

Example 3 includes the apparatus as defined in example 1, further including a shaft key configured to eject the separable nut portion from the drive socket and into the interior of the fastener interface.

Example 4 includes the apparatus as defined in example 3, further including a pressurized fluid line in fluid communication with the interior, configured to blow a separated nut portion within the interior towards the removal tube.

Example 5 includes the apparatus as defined in example 1, further including a blower manifold to direct pressurized fluid across the interior.

Example 6 includes the apparatus as defined in example 1, further including a collection bag coupled to the removal tube to capture the separated nut portion.

Example 7 includes the apparatus as defined in example 6, where the collection bag is at least partially composed of Delrin®.

Example 8 includes the apparatus as defined in example 1, where the vacuum generator comprises a venturi established by the removal tube and a conduit through which pressurized fluid flow is directed towards an evacuation end of the removal tube to induce a vacuum for urging a separated nut portion to exit the interior and travel through the removal tube.

Example 9 includes the apparatus as defined in example 1, further including a shoulder ring to apply a pressure against the frangible fastener.

Example 10 includes the apparatus as defined in example 1, further including a compression spring to press the fastener interface against an installation surface when the interior receives at least the nut portion.

Example 11 includes the apparatus as defined in example 10, further including a gasket to be compressed against the installation surface.

Example 12 includes a method of assembling a frangible fastener. The method includes providing an induced vacuum in a removal tube depending from an interior of a fastener interface positioned on or proximate an installation surface, where the frangible fastener is disposed within the interior, moving the frangible fastener, via a drive socket at last partially disposed in the interior, to install the frangible fastener and separate a removable nut portion from the frangible fastener; and removing, via the induced vacuum, the removable nut portion of the frangible fastener from the interior and through the removal tube.

Example 13 includes the method as defined in example 12, further including aligning the fastener interface with the frangible fastener.

Example 14 includes the method as defined in example 13, where the fastener interface is aligned with an outer surface of the frangible fastener.

Example 15 includes the method as defined in example 12, further including pressing the fastener interface against the installation surface.

Example 16 includes the method as defined in example 15, where the fastener interface is pressed against the installation surface to compress a gasket mounted to the fastener interface.

Example 17 includes the method as defined in example 12, where moving the frangible fastener includes rotating the frangible fastener until the removable nut portion is removed therefrom.

Example 18 includes the method as defined in example 17, further including restraining a threaded post via a shaft key as the frangible fastener is rotated.

Example 19 includes the method as defined in example 17, further including directing pressurized fluid across the interior.

Example 20 includes the method as defined in example 19, where the pressurized fluid flows transversely relatively to the frangible fastener.

From the foregoing, it will be appreciated that example methods, apparatus and articles of manufacture have been disclosed that enable effective removal of debris and/or remnants resulting from installation of frangible fasteners. Accordingly, examples disclosed herein can reduce undesired contamination of parts, work areas and/or manufacturing components.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure. While examples disclosed herein are shown in the context of frangible fasteners, examples disclosed herein can be applied to any appropriate application in which resultant debris are to be kept from occupying an area, tools and/or equipment.

What is claimed is:

1. An apparatus to install a frangible fastener, the apparatus comprising:

a drive tool having a drive socket operable to rotate a separable nut portion of the frangible fastener;

a fastener interface defining an interior for receiving at least the nut portion, the fastener interface being disposed on a drive end of the drive tool, wherein the drive socket is movable within the fastener interface and operable to rotate the frangible fastener, and wherein the separable nut portion of the frangible fastener is removed when the frangible fastener is installed;

a nut-portion removal tube depending from the interior of the fastener interface;

a vacuum generator in fluid communication with the removal tube and configured to cause the separable nut portion to be removed from the interior and through the removal tube; and a shaft key configured to eject the separable nut portion from the drive socket and into the interior of the fastener interface.

2. The apparatus as defined in claim 1, further including a spring operatively coupled between the fastener interface and the drive tool.

3. The apparatus as defined in claim 1, further including a pressurized fluid line in fluid communication with the interior of the fastener interface, the pressurized fluid line configured to blow a separated nut portion within the interior towards the removal tube.

4. The apparatus as defined in claim 3, wherein the pressurized fluid line is configured to cause pressurized fluid to flow transversely to the frangible fastener and toward the removal tube.

5. The apparatus as defined in claim 4, wherein the vacuum generator is fluidly coupled to the removal tube downstream from the fastener interface.

6. The apparatus as defined in claim 1, further including a blower manifold to direct pressurized fluid across the interior.

7. The apparatus as defined in claim 1, further including a collection bag coupled to the removal tube to capture the separated nut portion.

8. The apparatus as defined in claim 7, wherein the collection bag is at least partially composed of acetal polymer.

9. The apparatus as defined in claim 1, wherein the vacuum generator comprises a venturi chamber established by the removal tube and a conduit through which pressurized fluid flow is directed towards an evacuation end of the removal tube to induce a vacuum for urging a separated nut portion to exit the interior and travel through the removal tube.

10. The apparatus as defined in claim 1, further including a shoulder ring to apply a pressure against the frangible fastener.

11. The apparatus as defined in claim 1, wherein the drive socket is configured to rotate the frangible fastener until the separable nut portion is removed therefrom.

12. An apparatus to install a frangible fastener, the apparatus comprising:

a drive tool having a drive socket operable to rotate a separable nut portion of the frangible fastener;

a fastener interface defining an interior for receiving at least the nut portion, the fastener interface being disposed on a drive end of the drive tool, wherein the drive socket is movable within the fastener interface and operable to rotate the frangible fastener, and wherein the separable nut portion of the frangible fastener is removed when the frangible fastener is installed;

a nut-portion removal tube depending from the interior of the fastener interface;

a vacuum generator in fluid communication with the removal tube and configured to cause the separable nut portion to be removed from the interior and through the removal tube; and a compression spring to press the fastener interface against an installation surface when the interior receives at least the nut portion.

13. The apparatus as defined in claim 12, further including a gasket to be compressed against the installation surface.

14. A method of assembling a frangible fastener, the method comprising:

pressing a fastener interface against an installation surface, wherein the fastener interface is pressed against the installation surface to compress a gasket mounted to the fastener interface;

providing an induced vacuum in a removal tube depending from an interior of the fastener interface positioned on or proximate the installation surface, wherein the frangible fastener is disposed within the interior;

moving the frangible fastener, via a drive socket at last partially disposed in the interior, to install the frangible fastener and separate a removable nut portion from the frangible fastener; and removing, via the induced vacuum, the removable nut portion of the frangible fastener from the interior and through the removal tube.

15. The method as defined in claim 14, further including aligning the fastener interface with the frangible fastener.

16. The method as defined in claim 15, wherein the fastener interface is aligned with an outer surface of the frangible fastener.

17. The method as defined in claim 14, wherein moving the frangible fastener includes rotating the frangible fastener until the removable nut portion is removed therefrom.

18. The method as defined in claim 14, further including directing pressurized fluid across the interior.

19. The method as defined in claim 18, wherein the pressurized fluid flows transversely relatively to the frangible fastener.

20. A method of assembling a frangible fastener, the method comprising:

providing an induced vacuum in a removal tube depending from an interior of a fastener interface positioned on or proximate an installation surface, wherein the frangible fastener is disposed within the interior;

moving the frangible fastener, via a drive socket at last partially disposed in the interior, to install the frangible fastener and separate a removable nut portion from the frangible fastener;

removing, via the induced vacuum, the removable nut portion of the frangible fastener from the interior and through the removal tube; and restraining a threaded post via a shaft key as the frangible fastener is rotated.

* * * * *